United States Patent [19]

Lissau, deceased et al.

[11] Patent Number: 4,612,954

[45] Date of Patent: Sep. 23, 1986

[54] PEDAL OPERATED FLUSH VALVE

[75] Inventors: Frederic Lissau, deceased, late of Chicago, Ill., by Edith Lissau, executrix; Michael R. Stoltenberg, Des Plaines, Ill.

[73] Assignee: Sloan Valve Company, Franklin Park, Ill.

[21] Appl. No.: 714,216

[22] Filed: Mar. 21, 1985

[51] Int. Cl.[4] ..... F16L 5/00; F16K 31/62

[52] U.S. Cl. ..... 137/360; 251/80; 251/284; 251/295; 4/308; 74/512

[58] Field of Search ..... 137/360; 251/80, 228, 251/284, 295; 74/512, 513, 560, 478; 4/249, 251, 280, 308; 222/179, 186, 505

[56] References Cited

U.S. PATENT DOCUMENTS

| | | | |
|---|---|---|---|
| 732,955 | 7/1903 | O'Hara | 251/295 |
| 1,092,275 | 4/1914 | Long | 251/284 |
| 1,675,263 | 6/1928 | Flagg | 4/308 |
| 1,929,522 | 10/1933 | Schulte | 137/360 |
| 2,141,070 | 12/1938 | Newell | 251/80 |
| 2,693,716 | 11/1954 | Ludwig | 251/295 |
| 3,695,288 | 10/1972 | Billeter et al. | 137/360 |
| 3,778,023 | 12/1973 | Billeter | 251/30 |
| 4,120,314 | 10/1978 | Lissau | 137/360 |
| 4,300,409 | 11/1981 | Leighton | 74/512 |
| 4,454,497 | 6/1984 | Morse | 74/512 |

*Primary Examiner*—Martin P. Schwadron
*Assistant Examiner*—Sheri M. Novack
*Attorney, Agent, or Firm*—Kinzer, Plyer, Dorn & McEachran

[57] ABSTRACT

A pedal operated flushing system includes a hydraulically-actuated flush valve connected to a hydraulic fluid source by a supply line having a control valve therein. The control valve is mounted on a pocket portion of a bracket, the pocket forming an enclosure about an opening in a wall. A pedal is hinged to the bracket and normally covers the wall opening. The pedal pivots into the enclosure to actuate the control valve. A spring interposed between the pedal and control valve absorbs overtravel of the pedal toward the valve.

11 Claims, 4 Drawing Figures

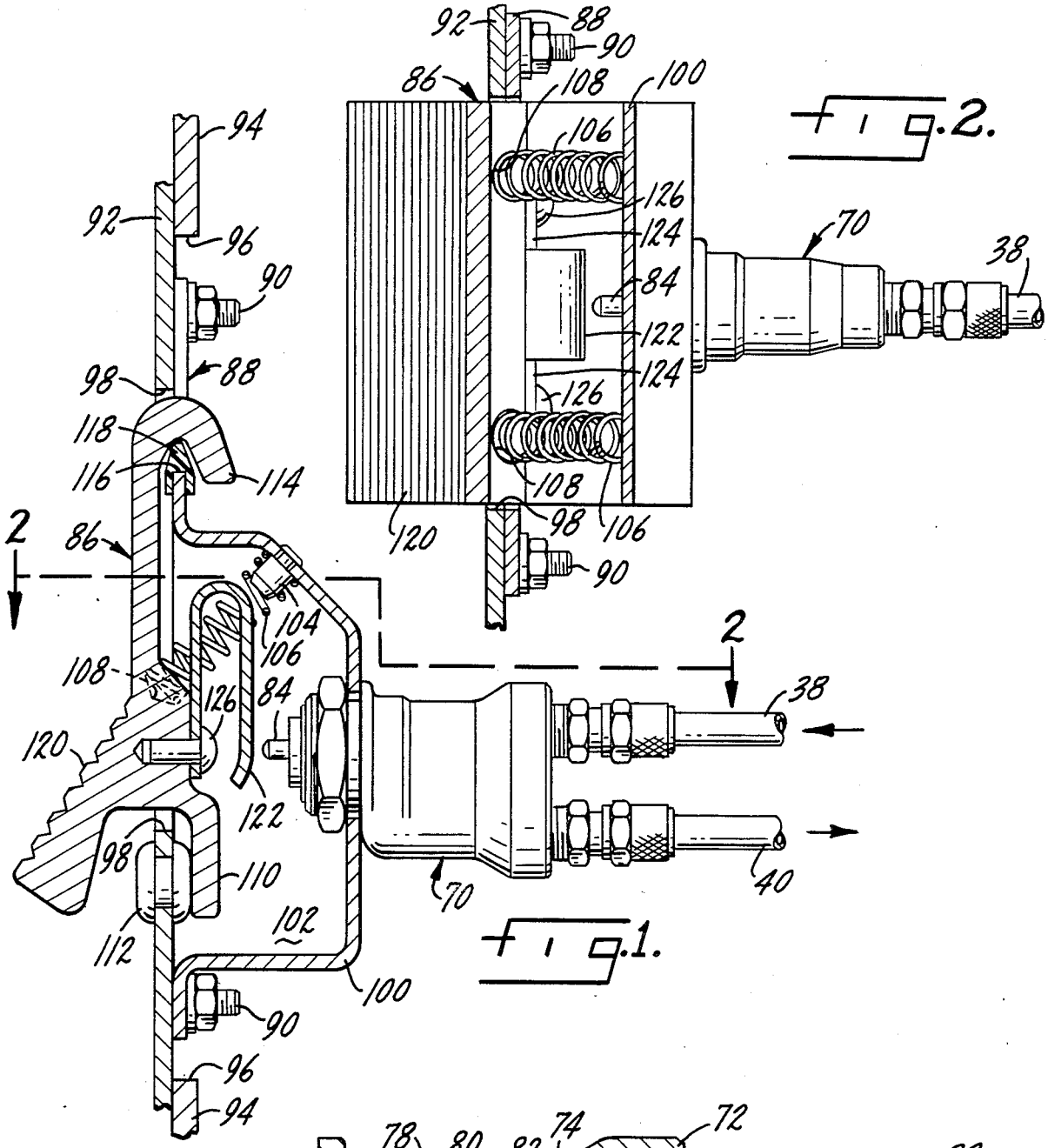
Fig. 2.
Fig. 1.
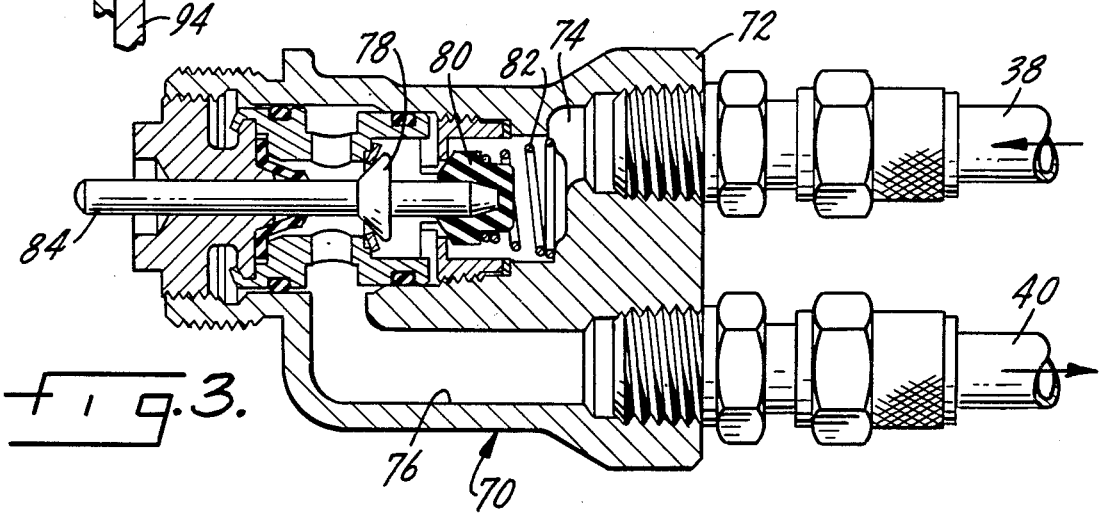
Fig. 3.

PEDAL OPERATED FLUSH VALVE

SUMMARY OF THE INVENTION

This invention relates to pedal operated flushing systems and is particularly concerned with a system wherein the flush valve is physically separated from the actuating mechanism.

A primary object of the invention is a pedal operated flushing system having an overtravel spring interposed between the pedal and a control valve.

Another object of the invention is a flushing system of the type described wherein the flush valve is remote from the pedal actuating mechanism.

A further object of the invention is a pedal actuated flushing system having a light touch to operate the system.

Another object of the invention is a pedal operated flushing system wherein the actuating mechanism can be fully assembled prior to installation.

Another object of the invention is a flushing system of the type described wherein the actuating mechanism is located so as to be protected from abuse.

Other objects will appear in the following specification, drawings, and claims.

BRIEF DESCRIPTION OF THE DRAWINGS

FIG. 1 is a side elevation view, with parts in section, of the actuating mechanism of the flushing system.

FIG. 2 is a section taken substantially along line 2—2 of FIG. 1.

FIG. 3 is a section through the control valve.

DETAILED DESCRIPTION OF THE INVENTION

Figure 4:
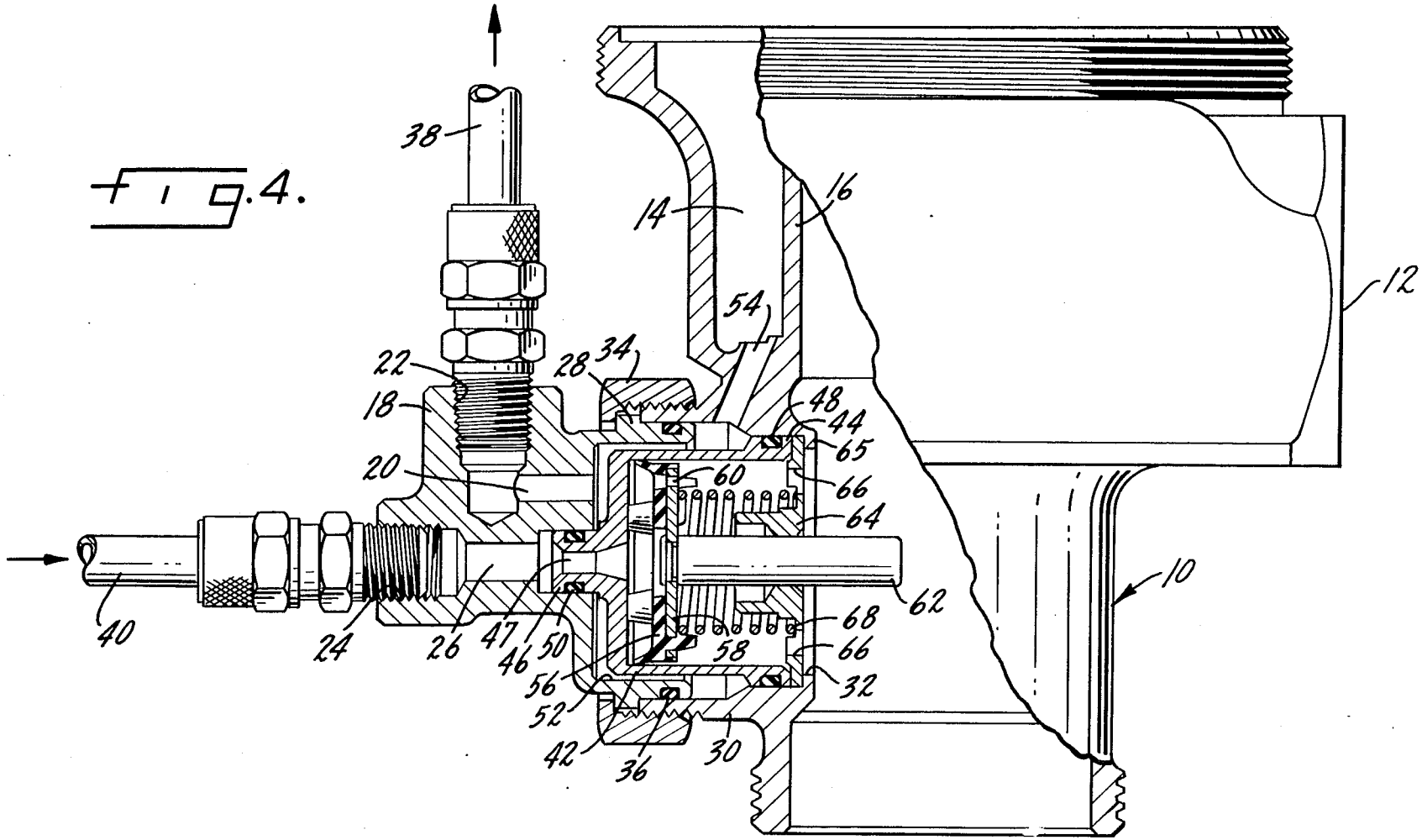
FIG. 4 is an elevation view, with parts in section, of the flush valve.

Referring first to FIG. 4, this illustrates a typical flush valve in which the parts may be concealed behind a wall and in back of the plumbing fixture which may be either a water closet or urinal. A typical installation is shown in U.S. Pat. No. 3,695,288. The flush valve may be a commercially known type such as the "Sloan Royal" flush valve. A typical valve of this type is shown and described in U.S. Pat. No. 3,778,023, issued Dec. 11, 1973. The valve is shown generally at 10 and has a water supply inlet 12. The inlet water supply pressure is present in a pressure chamber 14 around the barrel portion 16 of the flush valve 10.

The actuating arrangement and means for causing operation of the flush valve 10 includes a manifold 18. The manifold includes an outlet passage 20 in communication with a threaded outlet port 22. Similarly, a threaded inlet port 24 is in communication with an inlet passage 26. The manifold includes an extending casing portion 28 which fits within a threaded flange 30 on the flush valve. The flange surrounds an opening 32 in the side of the valve. A hex nut 34 engages the casing portion 28 of the manifold 18 to hold the manifold on the flange 30. A seal 36 prevents leakage between the casing and flange.

An hydraulic fluid supply line includes an outlet line 38 and a return line 40. The outlet line is connected by suitable couplers to the outlet port 22 while the return line is connected to the inlet port 24.

Arranged within the manifold 18 and its casing portion 28 and within the flange 30 is a cup-shaped sleeve 42. The sleeve has a rim 44 engaging the inside diameter of the flange 30 and a projection 46 that fits inside a socket in the inlet passage 26. The projection 46 has a central opening 47 providing fluid communication between the inlet passage 26 and the interior of the sleeve 42. The rim and projection also carry seals 48 and 50, respectively. The rim 44 and projection 46 allow the body of the sleeve 42 to be spaced from the inside diameter of the casing 28. The resulting gap forms an annular passage 52 which is in communication with the outlet port 20 of the manifold 18. The passage 52 in turn communicates with the pressure chamber 14 through passage 54.

A piston 56 is arranged for reciprocal movement within the sleeve 42. The piston is preferably constructed of rubber molded to a backup washer 58. The piston and washer have a bleed opening 60 formed therein. A plunger rod 62 is connected to the backup washer 58.

A spring retainer 64 is held between a lip 65 around the opening 32 and the rim 44 of the sleeve 42. The retainer includes openings 66 providing fluid communication back through the opening 32. The retainer has a central portion which holds a spring 68. The spring urges the piston 56 to the left as viewed in FIG. 4.

Turning now to FIGS. 1–3, the operating mechanism for the flushing system is shown. It includes a control valve shown generally at 70. Details of the control valve are shown in FIG. 3. It includes a body 72 having an inlet port 74 connected to the hydraulic supply line 38. There is also an outlet passage 76 connected to the return line 40. Flow of hydraulic fluid through the valve is controlled by conical seal members 78 and 80. These seals are normally biased against their seats by a spring 82. The seals are connected to an operating stem 84 which when actuated pushes the seals to the right, out of engagement with their seats, thereby allowing flow of fluid through the valve. Further details of a typical control valve are shown and described in U.S. Pat. No. 4,120,314, issued Oct. 17, 1978.

Looking now at FIGS. 1 and 2, the operating mechanism further includes a pedal 86 mounted on a bracket 88. The bracket is mounted to studs 90 which are in turn studwelded to one side of a faceplate 92. The faceplate 92 is suitably connected to the wall, portions of which are shown at 94. The wall has an opening 96 in which the bracket 88 fits. The faceplate 92 similarly has an opening 98 which accommodates the pedal 86. The opening 98 has an upper edge and a lower edge. The bracket 88 includes a pocket portion 100 on which the control valve 70 is mounted. The pocket forms an enclosure 102 which extends substantially about the opening 98 in the faceplate. A pair of spring retainers 104 are fixed to the pocket 100. They mount one end of springs 106. The other ends of the springs fit in recesses 108 in the pedal 86. The springs normally bias the pedal out of the enclosure 102. A finger portion 110 of the pedal extends into the enclosure 102 and below the lower edge of the faceplate opening 98. It engages a rubber gromment 112 which is fixed in the faceplate 92. This acts as a stop to hold the pedal 86 in the opening 98 of the faceplate.

The pedal is hinged to the bracket 88 by means of a hook portion 114 of the pedal engaging a slot 116 in the bracket. The slot 116 extends somewhat below the upper edge of the opening 98. This allows the hook 114 to fit through the opening and around the lower edge of the slot 116. A bearing member 118 preferably lines the lower edge of the slot to permit smooth pivoting of the pedal. The pedal further includes a tread portion 120 which extends below the lower edge of the opening 98. The tread is also engagable with the grommet 112 which acts as a stop to prevent overtravel of the pedal to the right in FIG. 1.

The pedal 86 further includes a U-shaped overtravel spring 122. The spring includes small ears 124 which are fastened to the pedal by screws 126. The purpose of the spring 122 is to absorb any overtravel of the pedal toward the control valve 70. That is, the stem 84 of the control valve has only a certain amount of travel available to it. If the pedal is pushed a greater amount than that available travel, the spring 122 will deflect so that the control valve is not damaged.

The use, operation and function of the invention are as follows. Hydraulic pressure fluid is always available at the inlet port 74 of the control valve 70 through the supply line 38. The supply line 38 is connected to a fluid source through port 22, passages 20, 52, 54, pressure chamber 14 and inlet 12. When it is desired to actuate the flush valve, the tread portion 120 of the pedal 86 is stepped on, pivoting the pedal into the enclosure 102 and causing the spring 122 to engage the stem 84 of the control valve. The stem 84 moves to the right in FIG. 3, removing the seals 78 and 80 from their seats. This allows pressure fluid to flow through the control valve to the return line 40. As explained above, any overtravel in the pedal is absorbed by deflection in the spring 122. When the pedal 86 is released, return springs 106 return it to the position in FIG. 1. Similarly, the spring 82 recloses the seals 78 and 80 against their seats.

Pressure fluid in the return line 40 enters the port 24 and from there flows through passage 26 and opening 47 and then acts on the piston 56. Since the bleed opening 60 is small, the pressure fluid moves the piston to the right, carrying the plunger rod 62 with it. The plunger rod actuates a valve stem (not shown) in the known manner. The flush valve 10 is also equipped with an operating diaphram (not shown) whose opening from the main flush valve seat is controlled by operation of a relief valve when the depending stem is actuated or tilted. The opening of the flush valve diaphram from its valve seat results in the water supply passing from the inlet 12 downward through the flush tube into the plumbing fixture to flush the same. After an interval when the flush valve seat is automatically closed, the water supply pressure is again present in the pressure chamber 14 around the barrel of the valve.

One of the advantages of the present invention is that the pedal operating mechanism can be pre-assembled before installation of the mechanism in the wall. That is, the faceplate, bracket, pedal and control valve can be assembled at the factory and the only installation required at the site is to fasten the faceplate to the wall and to connect the hydraulic lines between the flush valve and the control valve. Another advantage of the invention is that the pedal itself closes off virtually the entire opening in the faceplate thereby protecting the interior mechanism from abuse.

While a specific form of the invention has been shown and described herein, it will be understood that many modifications, alterations or changes could be made therein without departing from the scope of the following claims.

What is claimed is:

1. In a pedal-operated flushing system, a hydraulically-actuated flush valve connected by a hydraulic fluid supply line to a hydraulic fluid source, a control valve in the supply line between the source and flush valve, and a pedal for actuating the control valve, an improved mounting means for the pedal comprising, a faceplate suitable for attachment to a wall and covering an opening therein, the faceplate itself having an opening therein defining an upper and lower edge, a bracket attached to the faceplate on the side adjacent the wall opening, the bracket having a pocket forming an enclosure about the faceplate opening, the control valve being mounted on the pocket and extending into the enclosure, and the pedal being hinged to the bracket adjacent the upper edge of the faceplate opening, the pedal having a planar portion normally disposed parallel to the plane of the faceplate such that the planar portion normally substantially covers the faceplate opening and the hinged connection of the pedal and bracket, the pedal being pivotable into the enclosure to actuate the control valve.

2. The flushing system of claim 1 wherein the bracket has a slot cut therein extending below the upper edge of the faceplate opening, the pedal having a hook portion engaging the slot.

3. The flushing system of claim 2 wherein the slot is lined with a bearing strip.

4. The flushing system of claim 1 further comprising a spring attached to the pedal and interposed between the pedal and control valve such that the spring absorbs overtravel of the pedal toward the control valve.

5. The flushing system of claim 1 wherein the pedal has a tread portion extending below the lower edge of the faceplate opening and engagable with the faceplate.

6. The flushing system of claim 1 wherein the pedal has a finger extending into the enclosure and below the lower edge of the faceplate opening so as to be engagable with the faceplate.

7. The flushing system of claim 5 further comprising a rubber grommet fixed to the faceplate at a location where the tread hits the grommet when actuated.

8. The flushing system of claim 6 further comprising a rubber grommet fixed to the faceplate at a location where the finger hits the grommet on return of the pedal.

9. The flushing system of claim 1 wherein the bracket is retained on the faceplate by studs welded to one side of the faceplate.

10. The flushing system of claim 1 further comprising at least one return spring disposed between the bracket and pedal, urging the pedal out of the enclosure.

11. The flushing system of claim 10 wherein the return spring is fixed to the pocket by a spring retainer, with the other end of the spring disposed in a recess in the pedal.

* * * * *